US009121655B1

(12) United States Patent
Murphy, II et al.

(10) Patent No.: US 9,121,655 B1
(45) Date of Patent: Sep. 1, 2015

(54) LONG GUN PROTECTIVE TRIGGER GUARD ENCLOSURE

(71) Applicants: William Lewis Murphy, II, Orlando, FL (US); Robert Vail Harvey, Orlando, FL (US)

(72) Inventors: William Lewis Murphy, II, Orlando, FL (US); Robert Vail Harvey, Orlando, FL (US)

( * ) Notice: Subject to any disclaimer, the term of this patent is extended or adjusted under 35 U.S.C. 154(b) by 0 days.

(21) Appl. No.: 14/318,730

(22) Filed: Jun. 30, 2014

(51) Int. Cl.
*F41A 17/54* (2006.01)
*F41A 17/06* (2006.01)

(52) U.S. Cl.
CPC ..... *F41A 17/54* (2013.01); *F41A 17/06* (2013.01)

(58) Field of Classification Search
CPC ..... F41A 17/54; F41A 17/063; F41A 7/066
USPC ..... 42/70.07, 70.11, 70.06, 85, 90, 96, 106
See application file for complete search history.

(56) References Cited

U.S. PATENT DOCUMENTS

| | | | | |
|---|---|---|---|---|
| 1,834,410 | A * | 12/1931 | Loomis | 42/21 |
| 5,419,068 | A * | 5/1995 | Pages et al. | 42/70.07 |
| 6,253,480 | B1 * | 7/2001 | Florez | 42/70.11 |
| 7,030,729 | B2 * | 4/2006 | Albanesi et al. | 340/5.61 |
| 7,194,836 | B1 * | 3/2007 | Urban | 42/60 |
| 2010/0154271 | A1 * | 6/2010 | Victor et al. | 42/70.07 |
| 2012/0042556 | A1 * | 2/2012 | Vesligaj | 42/75.03 |
| 2014/0182180 | A1 * | 7/2014 | Murphy et al. | 42/70.07 |

* cited by examiner

*Primary Examiner* — Michael David
(74) *Attorney, Agent, or Firm* — Brainstorm Patents; Robin Lopez

(57) ABSTRACT

The present invention provides a means for restricting access to the trigger guard enclosure of a long gun. The present invention enshrouds the perimeter of the trigger guard enclosure preventing access when not in use. When the weapon is in use, the present invention slides away from the trigger guard enclosure and secures as a handgrip for use while aiming and firing the weapon, all the while remaining permanently affixed to the weapon.

10 Claims, 7 Drawing Sheets

LONG GUN PROTECTIVE TRIGGER GUARD ENCLOSURE

CROSS REFERENCE TO RELATED APPLICATIONS

Not applicable.

STATEMENT REGARDING FEDERALLY SPONSORED RESEARCH OR DEVELOPMENT

Not Applicable.

REFERENCE TO SEQUENCE LISTING A TABLE, OR A COMPUTER PROGRAM LISTING COMPACT DISC APPENDIX

Not Applicable.

BACKGROUND OF THE INVENTION

In recent times, references in cinematic and novelistic works have erroneously portrayed an overwhelming adoption of handguns by the general firearm owning populous. The statistical reality is that most firearms in the United States are long guns, as opposed to handguns. Long guns are a class of firearm that includes common weapons such as shotguns and rifles. Based on statistics from the 2012 "Gun Control Legislation" report from the Congressional Research Service, the number of rifles and shotguns owned in the U.S. outnumbers the number of handguns owned nearly two to one. In 2012, there were an estimated 110 million rifles and 86 million shotguns owned by U.S. civilians, compared to the 110 million civilian-owned handguns. Given that nearly 200 million long guns are owned by civilians, any improvement in weapon safety results in a significant impact to the overall safety of society.

Accidental discharge of a weapon is a serious danger to everyone. To this end, a great deal of emphasis is placed on the proper handling of guns and ammunition in order to reduce the possibility of inadvertently injuring someone while handling a weapon. The reasons and scenarios leading to the discharge of the weapons vary widely from case to case, but one common factor of all accidental shootings is that they can be avoided by using safe weapon stowage and handling procedures, combined with an awareness of the present environment and surroundings.

While there are a large number of methods for securing a firearm available today, most are cumbersome and require varying amounts of operator input. Some securement methods are not portable, thereby limiting gun safety to the one location in which the gun is normally kept. With other currently available portable devices, in order to secure the weapon, the operator is required to carry a physical key, attach or remove parts, remember a particular set of procedures, or remove the ammunition. Still other safety devices require the weapon's mechanical components to be disassembled, altered, and re-assembled. In short, many options for safely storing a firearm are available, but each of these options makes it difficult and inconvenient to ensure that a firearm is not capable of harm.

Perhaps the most secure method of protecting a firearm is to store it in a locker or trunk. However, due to their sheer size and weight, these units are primarily designed to be installed and operated within the confines of a single environment, i.e., a gun owner's bedroom or vehicle. Once the weapon is removed from the locker, there is little to prevent the unauthorized use of the weapon.

As an alternative to storage lockers, people can install portable safety devices on their weapons. To use these devices, an owner has his weapon modified from the original production configuration to incorporate safety mechanisms that prevent the weapon from being inadvertently discharged. This process may result in the loss of warranty and liability claims to the weapon's manufacturer. This modification often results in a safety system that is not visible, thus not readily verifiable at any given point in time. Additionally, a system that is incorporated into the mechanical workings of the gun may not be obvious to people other than the owner, thus causing difficulty when others attempt to engage the safety features of the weapon.

Some of the portable aftermarket safety units available today are inserted into various parts of the firearm and then locked, preventing the pieces from being removed, thus preventing the gun from firing. While this type of protection presents a clean and cost effective solution, it requires the user to keep track of the insert and a key, which are not stowed on the firearm itself when the weapon is in use. A variation on the aftermarket insert is the trigger guard insert or cover that prevents access to the weapon's trigger. This safety component removes the ability to fire the weapon, regardless of whether the weapon is loaded or not. As with the other available aftermarket solutions, the trigger guard lock requires storage of the lock, and often a key, when the gun is in use. While the trigger guard lock is a good method for preventing access to the trigger, it can get lost or misplaced, still causing opportunity for the weapon to be discharged unintentionally.

It is the aim of the present invention to address the shortfalls of the prior art described above.

BRIEF SUMMARY OF THE INVENTION

The present invention specifically pertains to the subsection of firearms referred to as long guns and any derivatives, thereof. The National Firearms Act defines long guns as guns having a barrel length in excess of 16" for rifles and 18" for shotguns. It is the intent of the present invention to provide a method for safely securing a firearm in an easy, efficient and portable method whereby completely sealing off access to the trigger guard enclosure of a long gun, thus preventing the unauthorized firing of the weapon. Furthermore, as the apparatus used for the sealing of the trigger guard enclosure is permanently affixed to the firearm, the complexity of safety system securement and storage while the weapon is in firing mode is reduced. An additional intent of the present invention is to provide a means for gripping and holding the weapon while the weapon is in firing mode.

Traditionally, firearms have built-in safety mechanisms that, when engaged, prevent the weapon from firing. While the built-in safety has prevented countless accidental discharges, it is easily bypassed and does not provide a secure, fully enclosed guard that restricts unauthorized access to the trigger. The safety mechanism may be disengaged unassumingly, resulting in an unintended weapon firing when an uneducated weapon handler depresses the trigger. The present invention fully encloses the trigger and trigger guard, ensuring that regardless of the state of the safety mechanism, it is not possible for the weapon handler to access the trigger and inadvertently fire a round.

Unlike much prior art, the present invention is permanently secured to the long gun. There are many advantages to having the weapon securement method affixed to the firearm in a permanent fashion. The most significant advantage is the fact that the safety of the weapon is increased because the safety guard can never be misplaced or forgotten. With the device permanently attached, securing the weapon is always possible. A second advantage of having the present invention permanently affixed to the weapon is that the likelihood for tampering or altering of the device is greatly reduced, since the weapon will never be out of the weapon handler's possession. With the possibility of tampering being greatly reduced, the safety of the weapon is increased. Yet another advantage of having the present invention affixed to the weapon is the ability to reduce the likelihood of faulty use and securement. The user will have a reduced number of options and variables for use of the present invention based on the secured orientation and location in reference to the long gun.

An added benefit of the present invention over the prior art is its functionality as a handgrip. The present invention serves as the operator's firing-hand grip when it is not in "safe" mode. The fact that the grip is "missing" when the weapon is in a non-operable mode further enhances the safety and security of the weapon. In order achieve access to the weapon's trigger, the present invention must be released and converted to a handgrip in order to achieve access to the weapon's trigger. This measure creates an additional level of safety for anyone not formally trained and educated on the use of the weapon.

With these improvements on the existing prior art, the present invention provides tremendous value to any long gun owner, civilian or military.

Figure 1:
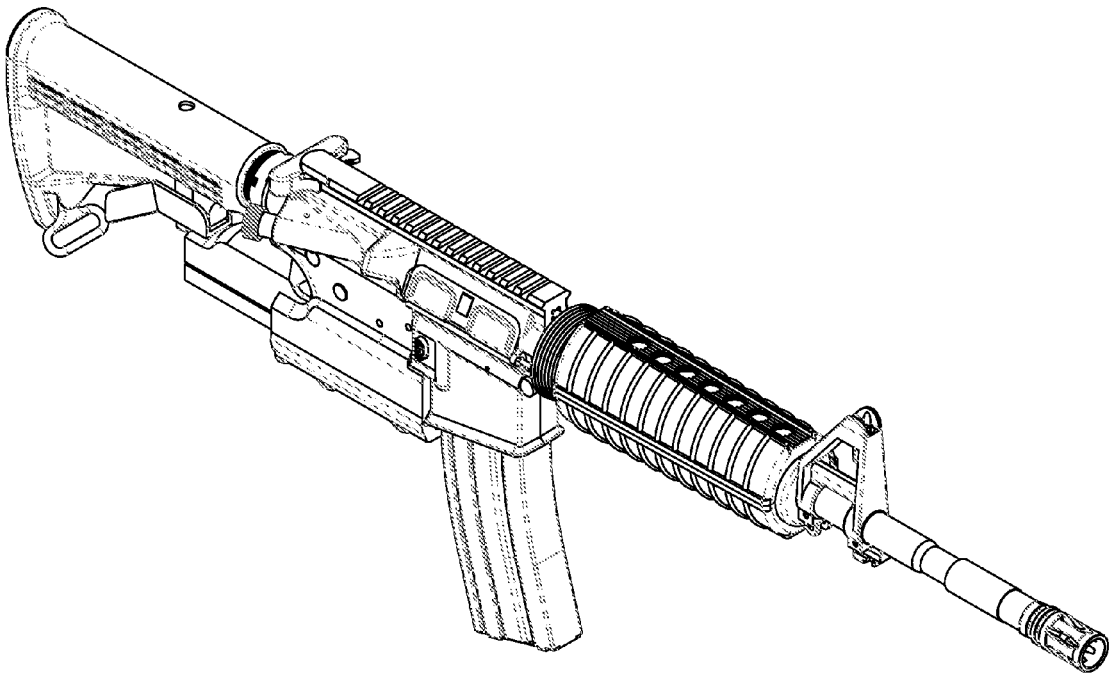
FIG. 1. This figure provides a perspective view of the present invention installed on a rifle in the deployed (closed) position.
Figure 2:
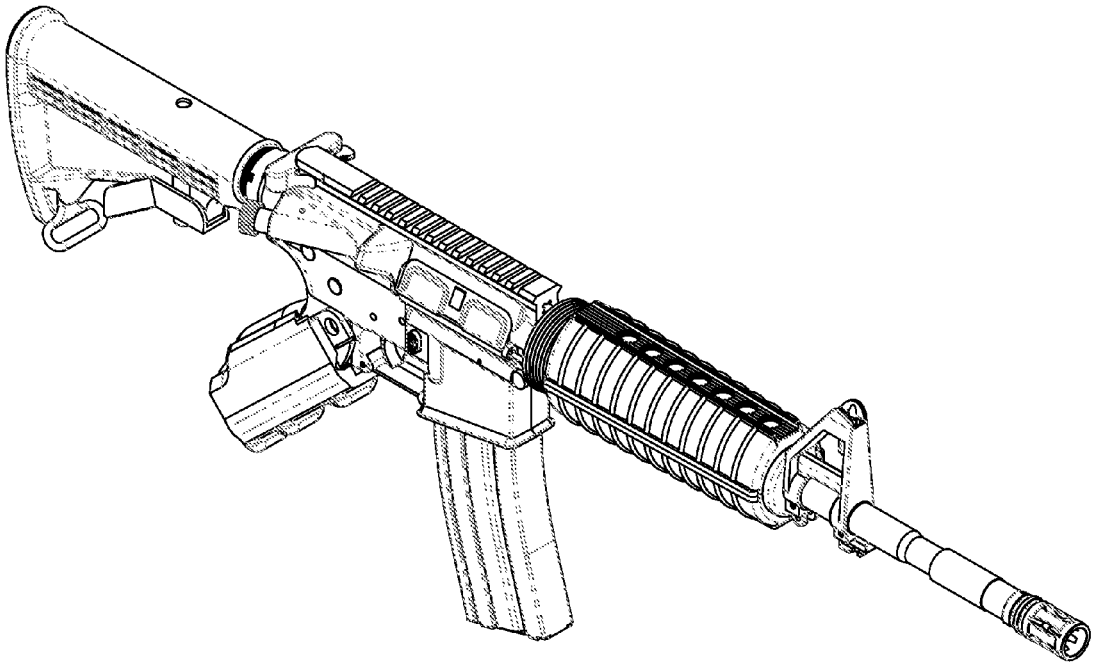
FIG. 2. This figure provides a perspective view of the present invention installed on a rifle in the retracted (open) position.
Figure 3:
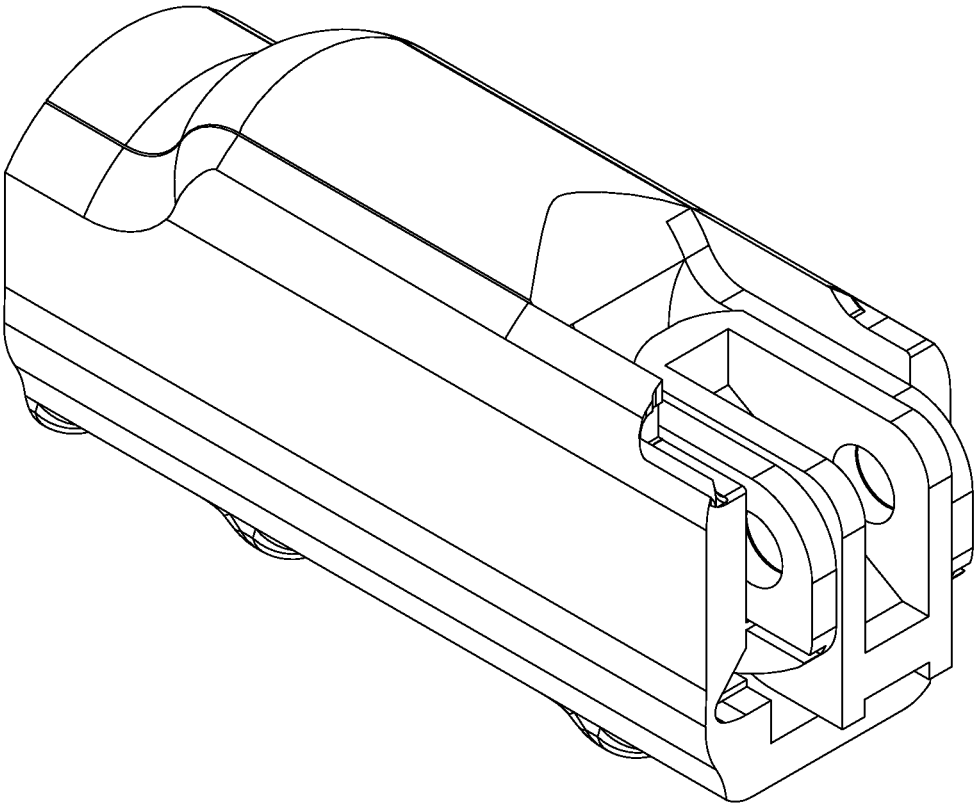
FIG. 3. This figure provides a perspective view of the stand-alone present invention.
Figure 4:
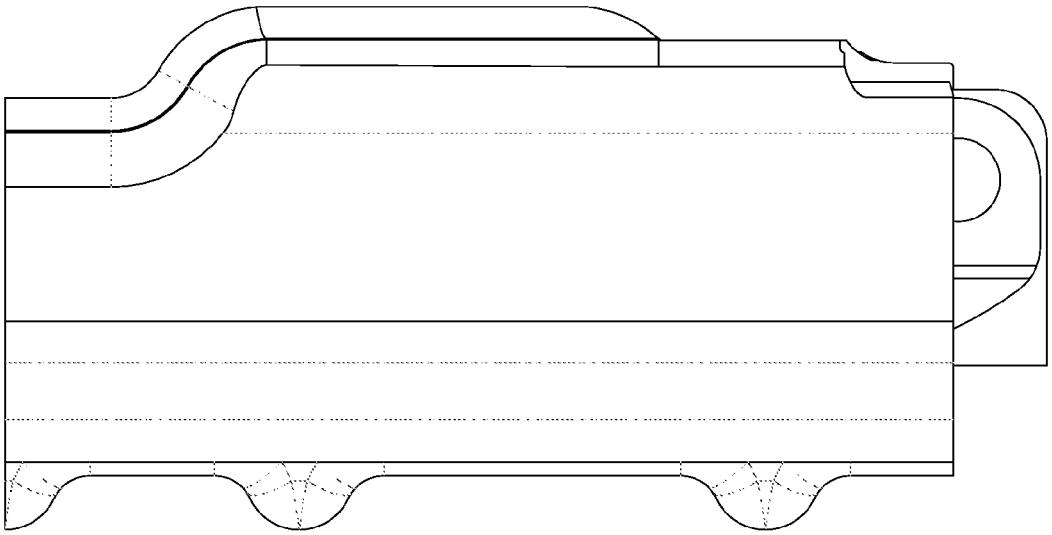
FIG. 4. This figure provides a side view of the present invention.
Figure 5:
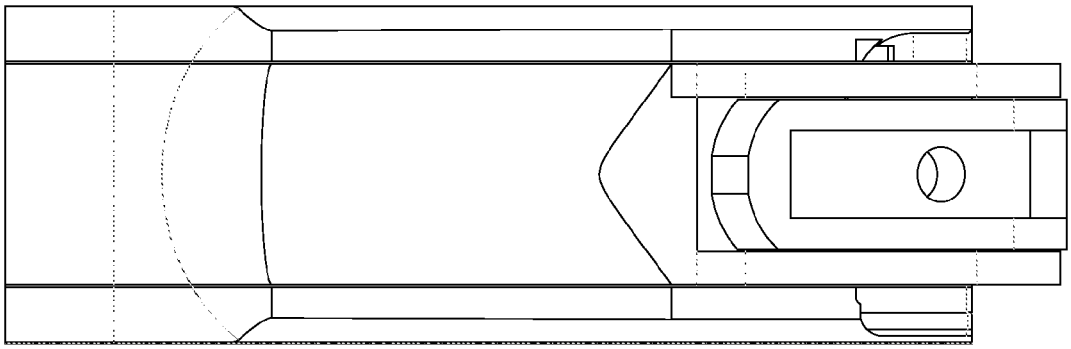
FIG. 5. This figure provides a top view of the present invention.
Figure 6:
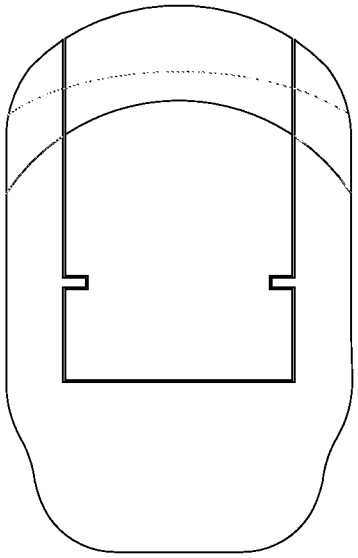
FIG. 6. This figure provides a rear view of the present invention.
Figure 7:
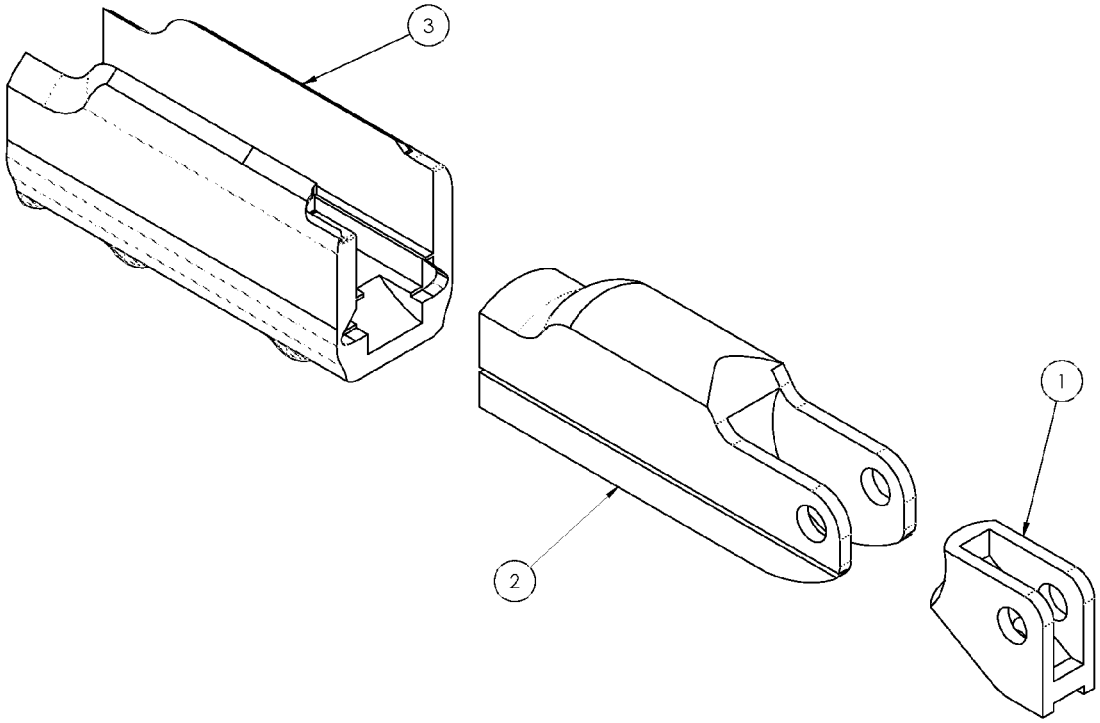
FIG. 7. This figure provides an exploded assembly view of the present invention. The items in the exploded view are as follows.

1. Attachment Pivot Plate
2. Pivoting Housing
3. Sliding Housing

DETAILED DESCRIPTION THE INVENTION

The present invention, the Long Gun Protective Trigger Guard Enclosure (LGPTGE), discloses a novel approach to securing and restricting access to the trigger guard, and more specifically, the trigger of various types of long guns and long gun derivatives. In an effort to fully disclose all aspects of the present invention, definitions for critical terms are provided for reference. All definitions are specific to the present invention and solely for the purpose of providing a clear description of the present invention. The terms may have alternative meanings when used in different context outside the scope of this description.

A firearm, for the purposes of this description, relates to a mechanical device intended for aiming and discharging a bullet or other projectile in a given direction with the intent of hitting a desired target. A long gun is defined as a firearm having an extended barrel length and intended to be fired when rested against the handler's shoulder while being aimed and handled with both hands—one hand steadying the barrel of the firearm while the other hand is discharging the weapon. A long gun derivative would be any firearm with a rifle style lower and/or upper receiver that may not fall within the previously provided definition of a long gun. A firearm trigger is a spring-loaded protrusion that is mechanically connected to the firing sequence necessary to discharge a projectile from the weapon. The trigger is usually depressed by the handler's index finger. In an effort to prevent inadvertent depressions of the trigger, the trigger is normally contained within a trigger guard. The trigger guard is a continuous protective piece allowing insertion of the handler's finger from the side of the weapon, but not from above or below the trigger area. A handgrip is a protrusion extending outward from the main body of the firearm intended to provide a means for grasping and directing the weapon. For the purposes of this description, the long gun has a longitudinal axis extending from the butt stock to the tip of the weapon's barrel. The long gun is defined as being upright when held in a position such that the trigger area is beneath the barrel of the firearm.

The LGPTGE is a permanent attachment to any long gun having a handgrip called a pistol grip that extends orthogonally from the longitudinal axis of the long gun and is used as a means of gripping the weapon while depressing the weapon's trigger. This handgrip is referred to as a pistol grip. The pistol grip is located aft of the trigger guard (towards the butt stock of the firearm), allowing the weapon handler to firmly hold the weapon and depress the trigger with a single hand, while the handler's second hand is positioned forward of the trigger guard along the barrel of the weapon, providing stability and accuracy when aiming and firing the weapon.

The LGPTGE is comprised of three primary components: an attachment pivot plate, a pivoting housing and a sliding housing. The attachment pivot plate, once permanently affixed to the long gun, remains in a fixed location relative to the other portions of the long gun. The attachment pivot plate allows for proper securement of the present invention to the long gun. The manufacturer's aft handgrip is removed and the attachment pivot plate is permanently affixed to the long gun body using the same screw and screw receiver threads. This piece is the connection to the long gun that allows for the sliding and pivoting of the other two components to function properly.

In the preferred embodiment, the pivoting housing is a hollow tubular member, allowing for internal placement of a variety of electrical and mechanical components needed for secured locking of the present invention over the trigger guard. The pivoting housing is affixed to the attachment pivot plate with a large diameter pin at the proximal end of the tubular member. This pinned connection is protected and not visible to potential tampering due to the fact that the sliding housing rides along the external face of the pivoting housing. The pivoting housing has the ability to pivot from a position that is parallel to the longitudinal axis of the long gun to a position that is orthogonal to the longitudinal axis. When pivoted parallel to the longitudinal axis, the pivoting housing is of such length that it does not interfere with the butt stock of the firearm.

The sliding housing is designed to fully enshroud the entire area bounded by the trigger guard and the underside of the weapon. The fit of the sliding housing is such that it interfaces cleanly with the underside of the weapon as well as the aft face of the magazine receiver. This smooth fit reduces the possibility that someone could insert any prying tool into the interface seam and deform the sliding housing in a way that would allow access to the trigger. The "U" shaped profile of the sliding housing allows for the housing to slide along the longitudinal axis of the weapon. In the preferred embodiment, the underside of the sliding housing is contoured to allow for ease of gripping when sliding and using as a pistol grip. The design of the sliding housing is such that no portion of the housing enters within the trigger guard area, greatly minimizing the possibility of accidental discharge due to inadvertent trigger depression while securing the trigger guard. Additionally, the LGPTGE sliding housing is designed in such a way that it interferes with the release of the safety mechanism on the long gun, preventing firing of the weapon unless the sliding housing is in the retracted state.

The sliding housing makes contact with the exterior face of the stationary housing, providing a strong and efficient means for a sliding rail connection between the two pieces. The sliding rail connection is comprised of a notched "V" depression running longitudinally along the exterior face of the stationary housing that mates with a raised "V" protrusion running longitudinally along the interior face of the sliding housing.

When in the retracted, or open, state, the connection to the pivoting housing allows the unit to pivot orthogonally to the longitudinal sliding direction at the pinned joint with the attachment pivot plate to create a secure pistol grip for use when the trigger area is open and ready for firing. All of the motions, both sliding and pivoting, have motion locks that must be overridden prior to any new movement occurring.

The present invention uses the internal cavity of the pivoting housing to store the various subcomponents needed to drive and secure the system. The system is powered using a rechargeable battery pack accessible in both the open and closed states of the system. The battery pack provides power to a drive motor. The drive motor is responsible for driving the physical locks to ensure that the weapon is in a permanent handler desired state (open or closed) until additional input from the handler is received. The battery pack is also responsible for powering the handler interface and the logic control unit. While the drive motor, battery pack and logic control unit are housed within the pivoting housing, the handler interface is not. The handler interface is mounted on an external face of the sliding housing. The interface must be accessible during all phases of use, regardless of location or orientation of the LGPTGE unit. The handler interface may take many different forms. The interface may be a traditional numerical keypad; alternatively, it may be a biometric sensor system capable of verifying fingerprints or other unique physical traits; alternatively, it may be a Bluetooth sensor system that interfaces with a handler's cellular phone; alternatively, it may be a voice activated system responding to specific voice prompts. The modular design of the LGPTGE system allows for interchangeability between various different sliding housings while still maintaining the same attachment pivot plate and pivoting housing.

In the preferred embodiment, the present invention uses an electro-mechanical drive and lock system to secure the LGPTGE in either the "safe" or "fire" modes. However, in an alternative embodiment, the LGPTGE can be used without an electro-mechanical drive and lock system, reducing the LGPTGE to a manual sliding and pivoting system that is fully powered by the handler's motions. This reduced complexity system may be preferred by military personnel who are not concerned with weapon interaction in a residential or private setting by untrained handlers. In this embodiment the hollow portion of the pivoting housing can be used as a storage cavity capable of housing additional materials or supplies (projectiles, flashlight, survival kit or tools, etc.).

Installation of the LGPTGE system is direct. As mentioned previously, the system is intended to be a replacement for the manufacturer provided aft handgrip on long guns. The manufacturer provided stock handgrip must be unscrewed from the gun body. Once removed, the LGPTGE can be fastened to the gun body with the same manufacturer provided screw. The attachment screw is only accessible when the LGPTGE is in the open state, preventing any possibility of removal of the system while it actively preventing access to the trigger. Once the LGPTGE system is screwed on securely, the system is ready for use.

Use of the LGPTGE system is intended to be straightforward to reduce any confusion during times of duress and chaos typically associated with the discharging of a firearm. Once the LGPTGE is installed, the electro-mechanical variant of the system can be operated effortlessly. By providing the necessary authorization code (whether it be biometric, alphanumeric or environmental), the locking pins will release, allowing for the handler to pivot and slide the unit as desired. Once the unit has been placed in its intended orientation and location, confirmation via the handler interface will lock and set the LGPTGE until additional input is received from the handler, at which time, removal or relocation of the components would be possible.

The present invention may be configured with a remote sensing telemetry unit. The purpose of the telemetry unit is to notify an unsuspecting firearm owner of unauthorized attempts at accessing the trigger guard of the firearm. Various modes and settings can be created to notify a particular remote device (owner's cellular phone, owner's alarm system, police network) upon a variety of inputs including, but not limited to, incorrect authorization code, successful opening of LGPTGE system, physical tampering of LGPTGE system and low battery charge status. The telemetry unit is designed as a digital notification and safeguard adding a final layer of safety to the present invention.

As many changes could be made in the above construction and many apparently widely different embodiments of this invention could be made without departing from the scope thereof, it is intended that all matter contained in the above description or shown in the accompanying drawings shall be interpreted as illustrative and not in a limited sense.

It is also to be understood that the language used in the following claims is intended to cover all of the generic and specific features of the invention herein described and all statements of the scope of the invention, which, as a matter of language, might be said to fall there between.

What is claimed:

1. A system configured for restricting access to a firearm trigger comprising: a stationary attachment plate removably affixed to a firearm, configured for rotatably interfacing with a non-stationary member via a pinned connection; a hollow, tubular member, capable of internal storage, configured for rotating axially from a parallel position along the longitudinal axis of said firearm to a perpendicular position with reference to the longitudinal axis of said firearm with means for connecting to a stationary attachment plate and a non-stationary enclosure; a non-stationary concave enclosure configured for fully enshrouding the trigger guard and the trigger guard, configured for retracting axially along longitudinal axis of said firearm; whereby said components are installed to the underside of the firearm body in a location traditionally reserved for the firearm's aft pistol grip and rearward of the trigger guard.

2. The system as set forth in claim 1, whereby said system cannot be removed from firearm while the non-stationary enclosure is in a fully extended state, fully enclosing the trigger guard area.

3. The system as set forth in claim 1, which installs on the rear pistol grip mounting threads of said firearm.

4. The system as set forth in claim 1, which rotatably converts to function as a rear pistol grip for said firearm.

5. The system as set forth in claim 1, which additionally comprises:

a rechargeable and portable power source contained within the hollow, tubular member;

an electromechanical drive system contained within the hollow, tubular member, which propels the non-stationary concave enclosure;

a user-customizable interface method permanently affixed to exterior face of the non-stationary concave enclosure used to activate the electromechanical drive system.

6. The system as set forth in claim 2, which does not allow for relocation of non-stationary concave enclosure unless electromechanical drive system is activated.

7. The system as set forth in claim 2, which comprises a tactile keypad as the interface method.

8. The system as set forth in claim 2, which comprises a biometric scanner as the interface method.

9. The system as set forth in claim 2, which comprises an external port for recharging internal power source.

10. The system as set forth in claim 2, which comprises a telemetry unit capable of relaying the state of the system to a remote user or device.

* * * * *